US010111487B2

(12) United States Patent
Hampton

(10) Patent No.: US 10,111,487 B2
(45) Date of Patent: Oct. 30, 2018

(54) WEARABLE ITEMS HAVING WEAR-SUSCEPTIBLE AREAS OR INDICIA FOR INFLUENCING AN EMOTIONAL OR PSYCHOLOGICAL STATE

(75) Inventor: Mark Hampton, New Castle, DE (US)

(73) Assignee: Hampton Technology Resources Inc., Wilmington, DE (US)

( * ) Notice: Subject to any disclaimer, the term of this patent is extended or adjusted under 35 U.S.C. 154(b) by 375 days.

(21) Appl. No.: 13/358,712

(22) Filed: Jan. 26, 2012

(65) Prior Publication Data

US 2012/0117716 A1 May 17, 2012

Related U.S. Application Data

(63) Continuation-in-part of application No. 12/612,906, filed on Nov. 5, 2009, now abandoned.

(51) Int. Cl.

| | |
|---|---|
| ***A43B 3/00*** | (2006.01) |
| ***A43B 7/00*** | (2006.01) |
| ***A43B 17/00*** | (2006.01) |
| *A41B 11/00* | (2006.01) |

(52) U.S. Cl.

CPC ..... *A43B 3/0078* (2013.01); *A43B 7/00* (2013.01); *A43B 17/003* (2013.01); *A41B 11/001* (2013.01)

(58) Field of Classification Search

USPC ..... 40/636, 661.04, 586; 36/112, 136; 2/115, 244, 245, 246; 283/102; D2/908, D2/951, 952

See application file for complete search history.

(56) References Cited

U.S. PATENT DOCUMENTS

| | | | | |
|---|---|---|---|---|
| 4,728,538 | A | 3/1988 | Kaspar et al. | |
| 4,734,938 | A | 4/1988 | Anderson | |
| 4,958,446 | A * | 9/1990 | Brown | 36/11.5 |
| 5,193,815 | A * | 3/1993 | Pollard | 273/269 |
| 5,584,077 | A | 12/1996 | Thrift | |

(Continued)

FOREIGN PATENT DOCUMENTS

| | | | |
|---|---|---|---|
| JP | 2002-371412 | A | 12/2002 |
| JP | 2004-183202 | A | 7/2004 |

(Continued)

OTHER PUBLICATIONS

Saltzberg, E.A. et al., "Beauty is the Beast: Psychological Effects of the Pursuit of the Perfect Female Body." In *Women: A Feminist Perspective*, Freeman, J. (Ed.), 5th Ed., Mountain View, CA: Mayfield Publishing Company, 1995, 306-315.

(Continued)

*Primary Examiner* — Joanne Silbermann
(74) *Attorney, Agent, or Firm* — Kim Winston LLP

(57) ABSTRACT

Wearable items having wear-susceptible areas or indicia for influencing an emotional or psychological state, after a progressive amount of wear occurs on the area or indicia, are disclosed. The wearable item comprises a substrate that includes wear-susceptible areas, wear-susceptible indicia, and/or a combination of wear-susceptible areas and indicia. One or more wear-susceptible areas incorporate markings and/or indicia such as words, pictures, symbols, which progressively "wear away." These phrases, symbols, and pictures can relate to emotional and/or psychological obstacles and impediments, which are adversarial in nature.

17 Claims, 5 Drawing Sheets

(56) References Cited

U.S. PATENT DOCUMENTS

| | | | | |
|---|---|---|---|---|
| 5,699,557 | A | 12/1997 | Johnson | |
| 5,943,702 | A * | 8/1999 | Kronenberger | 2/171.1 |
| 6,922,916 | B1 * | 8/2005 | Potter et al. | 36/31 |
| 6,931,768 | B2 * | 8/2005 | Baek | 36/113 |
| 6,957,504 | B2 * | 10/2005 | Morris | 36/136 |
| D568,032 | S * | 5/2008 | Lavergne | D2/917 |
| 7,878,030 | B2 | 2/2011 | Burr | |
| 8,082,762 | B2 | 12/2011 | Burr | |
| 2004/0216219 | A1 | 11/2004 | Brevoort | |
| 2005/0023288 | A1 | 2/2005 | Zill et al. | |
| 2005/0102734 | A1 | 5/2005 | Daniel et al. | |
| 2008/0301856 | A1 | 12/2008 | Errigo | |
| 2009/0077718 | A1 | 3/2009 | Hampton | |

FOREIGN PATENT DOCUMENTS

| | | | |
|---|---|---|---|
| JP | 03110327 | U9 | 5/2005 |
| JP | 2008-111225 | A | 5/2008 |
| JP | 2009-185433 | A | 8/2009 |

OTHER PUBLICATIONS

International Search Report for Int. Appl. No. PCT/US2013/023070.

* cited by examiner

WEARABLE ITEMS HAVING WEAR-SUSCEPTIBLE AREAS OR INDICIA FOR INFLUENCING AN EMOTIONAL OR PSYCHOLOGICAL STATE

CROSS-REFERENCE TO RELATED APPLICATIONS

This application is a continuation-in-part of application Ser. No. 12/612,906, titled "Therapeutic Footwear System, Methods and Devices," the entirety of which is incorporated herein by reference.

BACKGROUND

Field of the Invention

The field of the present invention relates to wearable items having wear-susceptible areas or indicia for influencing emotional and/or psychological states, after a progressive amount of wear occurs on the area or indicia.

Background

For many individuals, what they wear on any given day impacts their emotional or psychological state. These individuals would readily admit that when they wear certain items, their emotional or psychological state is positively impacted. For some that positive influence comes from wearing a favorite piece of jewelry, a comfy pair of socks, or a new pair of shoes. For others, it may be a certain hat, t-shirt or jacket that provides the influence. However, regardless of what item provides the influence, even children instinctively recognize the psychological or emotional influence of items that they wear.

Although few have studied the emotional or psychological influence of wearable items, at least one study has researched the effect certain clothing colors have on wearers' psychological states. In this study, red was shown to have a positive impact on performance in sport related activities. In contrast, white and other blander colors were shown to negatively influence the wearer of the item.

Unfortunately, conventional wearable items are susceptible to wear and will, over time, stop providing the positive influence they once had. After all, colors will fade, new shoes will wear out, blankets will become tattered, etc.

Wear can't be avoided. It comes from many sources, including wear caused by washing, various frictional sources, frequent use, etc. And when significant wear occurs, those once new and favorite wearable items will likely have a negative influence. As in the case with blander clothing colors that negatively influence a wearer, conventional wearable items having faded colors and worn areas will likely provide a negative influence.

Considering the potential of negative influences caused by wear, few, if any, manufacturers of wearable items have used the inevitable wear that occurs for emotional or psychological influence. Rather, the goal of these manufacturers is to provide materials that resist wear and use manufacturing methods that seek to prevent initial wear from occurring. In so doing, many manufacturers integrate wear-resistant materials on wear-prone areas. For example, socks are often reinforced at the heel because this is an area that wears quickly. Other types of clothing manufacturers provide reinforcement on other wear-prone areas such as elbows and knees.

Although these reinforced materials and methods are useful for their intended purpose, there is a clear need to use the inevitable wear that occurs on wearable items in a way that can cause emotional or psychological influence.

SUMMARY

The invention is directed to wearable items having wear-susceptible areas or indicia for influencing an emotional or psychological state, after a progressive amount of wear occurs on the area or indicia.

The wearable item comprises a substrate that includes wear-susceptible areas, wear-susceptible indicia, and/or a combination of wear-susceptible areas and indicia. In one aspect, one or more wear-susceptible areas incorporate markings. These markings comprise words, pictures, symbols or and/or a combination of words, pictures, and symbols, which are incorporated into the wear-susceptible area. The progressive "wearing away" of the markings over time has emotional and/or psychological significance to a wearer, a person, organization or a cause. In some embodiments, these phrases, symbols, and pictures relate to emotional and/or psychological obstacles and impediments, which are adversarial in nature, which an individual, organization, or cause has to overcome or is attempting to overcome.

In addition to, or in lieu of the markings, wear-susceptible indicia may be integrated with or disposed on one or more wear-susceptible areas. In contrast to markings, the indicia represent one or more appliques incorporated with or disposed on a wear-susceptible area. The indicia can also include various types of words, phrases and/or symbols that are included on the wearable item for influencing a wearer's emotional and/or psychological state.

In another aspect, the invention may incorporate wear-resistant markings and/or wear-resistant indicia disposed under the wear-susceptible area or indicia. In this aspect, the progressive "wearing away" of the markings and/or indicia still relates the removal of emotional and/or psychological obstacles and impediments, which are adversarial in nature. However, after the wear-susceptible areas or indicia are worn away, positive words, symbols, pictures, and phrases are revealed to reflect transformative goals and/or desires of an individual, organization, or cause.

BRIEF DESCRIPTION OF THE DRAWINGS

The drawings described herein are for illustrative purposes only and are not intended to limit the scope of the present disclosure. In the drawings.

DETAILED DESCRIPTION

Figure 1:
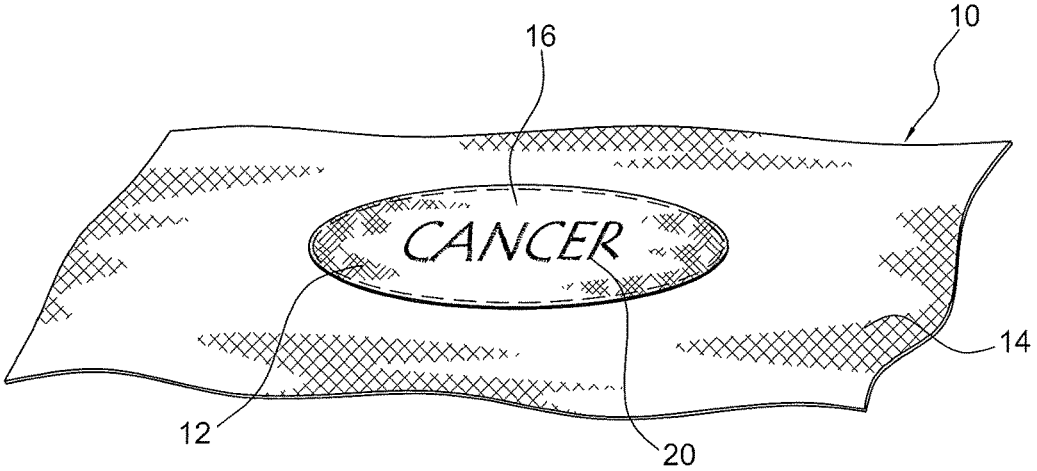
FIG. 1 is a representation of a section of a wearable item having a wear-susceptible area that incorporates a marking.
Figure 5A:
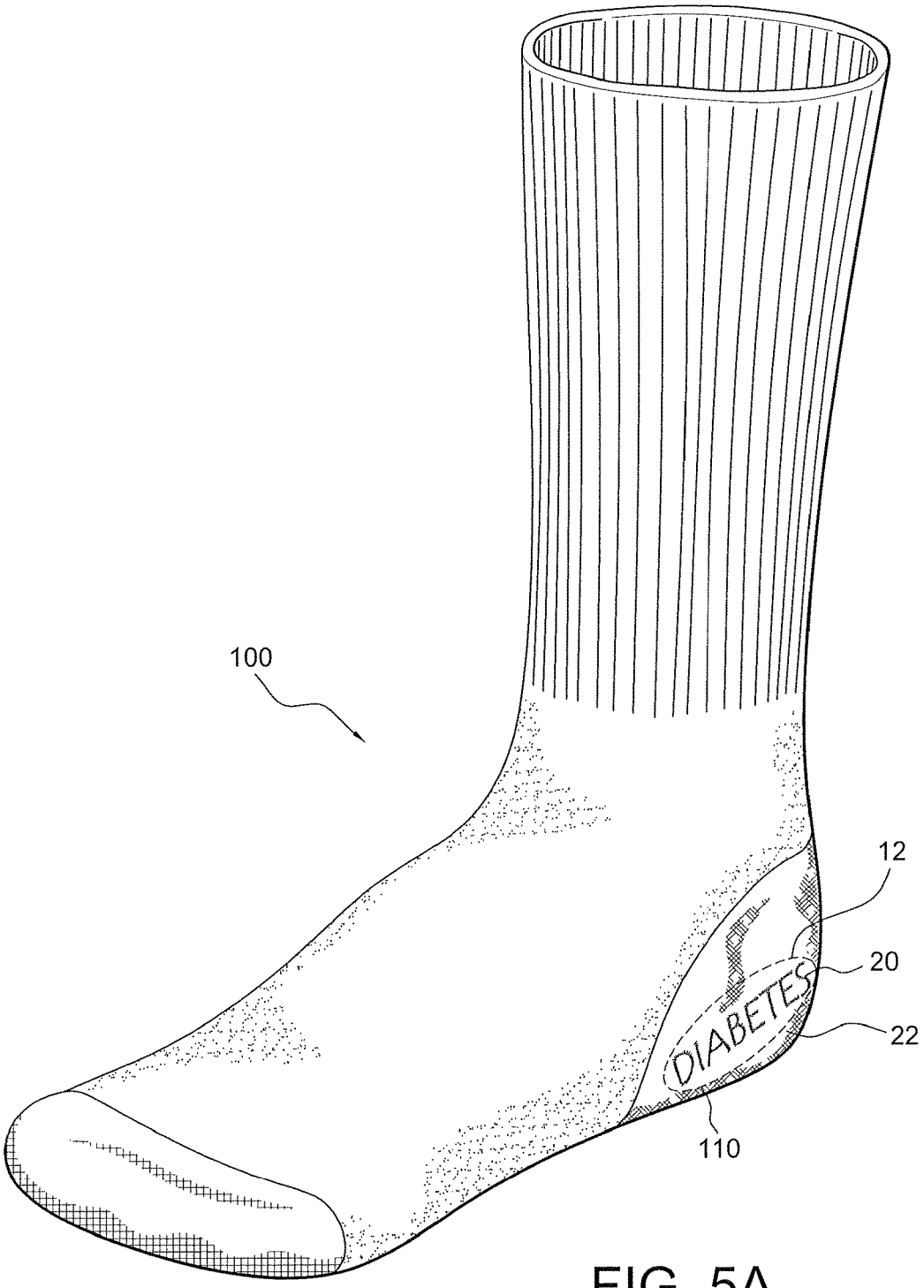
FIG. 5A is a perspective view of a first type of wearable item, incorporating both a wear-susceptible area and wear susceptible indicia.
Figure 5B:
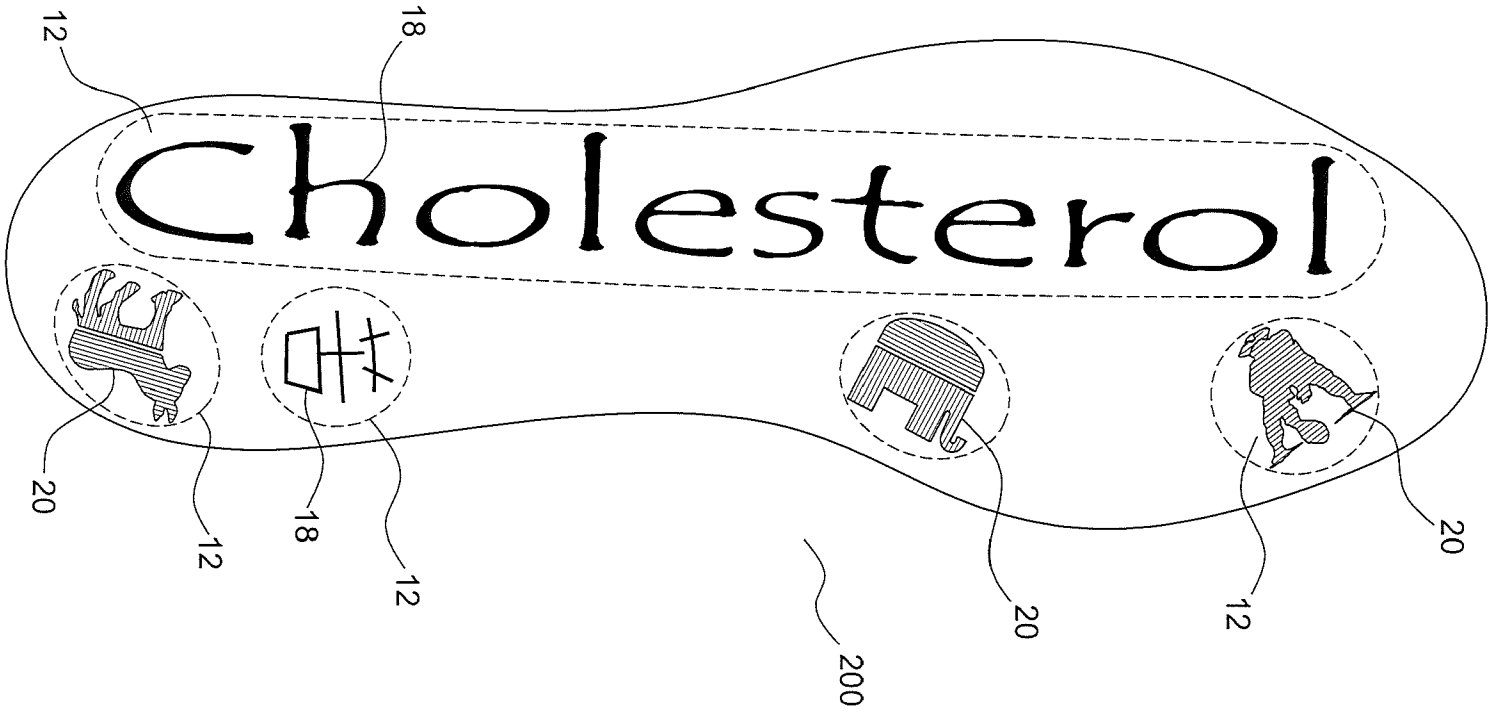
FIG. 5B is a bottom view of a wearable item incorporating a wear-susceptible area with either wear-susceptible markings and/or wear-susceptible indicia.

Turning in detail to the drawings, FIG. 1 shows a representation of a section 10 of a wearable item (e.g. as shown in FIGS. 5A-5B) comprising a wear-susceptible area 12 incorporated into a substrate 14. The wearable item includes any type of item capable of being worn on an animal. Such items include clothing or garments of any type and especially clothing or garments having one or more wear-prone areas, as further described below. Wearable items include, but are not limited to, hats, eyewear, neckwear (including ties and scarves), jewelry, shirts, belts, undergarments, pants, skirts, stockings, socks, shoes, outerwear, gloves, hosiery, and sports specific protective gear.

As used herein, the term "substrate" is broadly defined as any material which has a relative position that is partially or entirely disposed under, incorporated with, or that surrounds a wear-susceptible area. The substrate 14 material is preferably made of the same material as the wear-susceptible area. However, the substrate 14 can also be manufactured from any material that is generally compatible with the wear-susceptible area.

Moreover, the substrate 14 is made from any material suitable for manufacture as a wearable item. Examples of such materials include fabrics manufactured from natural and/or synthetic materials. Unconventional wearable materials such as metallics and composites, however, may also be suitable for use as a substrate 14 material. Although the substrate 14 is shown in a generally flat configuration, it may be coupled to or integrated with a wearable item having any geometry. Such geometry should, however, be such that manufacture as a wearable garment is feasible.

Incorporated into the substrate 14 are one or more wear-susceptible areas 12, as shown in FIG. 1. The wear-susceptible areas 12 may be subject to wear due to any known method. Such methods include adhesive wear, abrasive wear, surface fatigue, fretting wear, and erosive wear. In addition, wear may occur from the repeated application of stress to the wear-susceptible area 12. Examples of this latter type of wear occur when a wear-susceptible area is subject to repeated bending stress, as in the case with knee and elbow areas of various types of wearable items. In another aspect, wear may occur from placement of the wear-susceptible areas 12 under constant or alternating load.

The wear-susceptible area 12 can also comprise one or more weak or pre-stressed areas 16, having a weaker material strength than the surrounding substrate 14. These areas 16 may be manufactured from a material similar to a surrounding substrate 14. However, the weaker areas may also be coupled to the substrate 14 by any suitable method. For example, a wear-susceptible area 12 may be sewn into a substrate 14.

Wear susceptible areas 12 are preferably positioned on or incorporated with a wear-prone area 22 (FIG. 5A) on a wearable item. Such wear prone areas may be, e.g., where the wearable garment comes in repeated contact with various types or surfaces and/or where the wearable item is subject to repeated movements. In the case of a wearable item configured as hosiery, for example, the wear-susceptible area 12 may be positioned on the sole or underside of the hosiery.

One or more markings 20 comprising words, pictures, symbols or and/or a combination of words, pictures, and symbols are incorporated into the wear-susceptible area 12. The markings 20 may be incorporated into the wear-susceptible area 12 using any suitable method. For example, a marking 20 may be knitted, woven, or sewn into the wear-susceptible area 12.

The marking 20 depicts a representation of something that has significance to a wearer, an organization, or a cause such that when the marking progressively wears away, emotional and/or psychological influence occurs. The influence may be considered adversarial in the sense that that a symbolic intervention occurs when the marking is progressively worn away. Examples of markings 20 which are adversarial include diseases, addictions, sports teams, democratic parties, psychological diagnoses, health-related issues, sports mascots, personal issues, political parties, names of adversaries, causes, locations, municipalities, states, countries, business entities, and other various types of subject matter.

The marking 20 is made of a material that preferably wears away at a progressive rate that is the same or faster than that of the wear-susceptible area 12. Once the material progressively wears away, an individual such as the wearer, another individual, a group of persons, or an organization will be influenced emotionally or psychologically. This influence can have short-term or long-term benefits, depending on the words, pictures, or symbols depicted by the marking 20.

Figure 2:
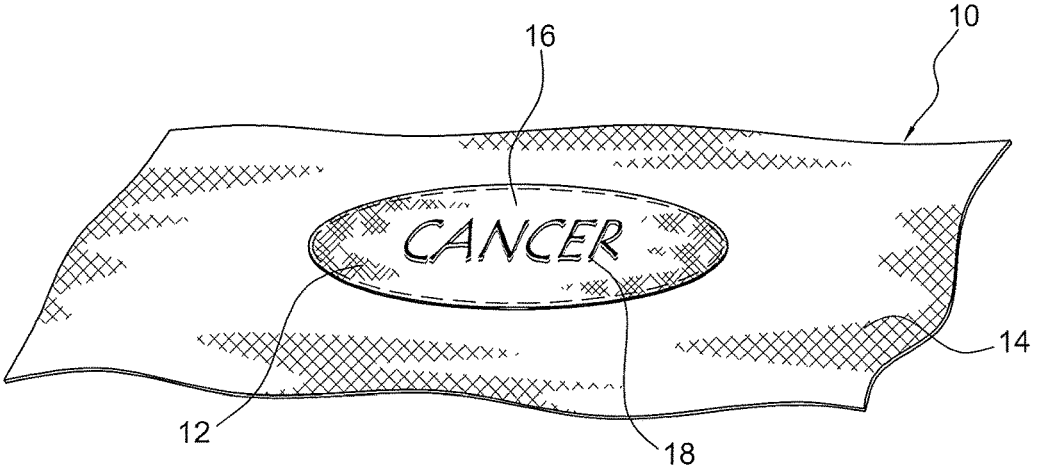
FIG. 2 is a representation of a section of a wearable item having wear-susceptible indicia.

In another aspect, shown in FIG. 2, wear-susceptible indicia 18 may be disposed on or incorporated into the substrate 14. In contrast to the marking, the wear-susceptible indicia 18 comprise an applique 28 that is applied to or incorporated into one or more wear-susceptible areas 12. The term applique, as used herein, is broadly defined as any type of indicia 18 applied to a wear-susceptible area that comprises a material different than the wear-susceptible area. An applique 28 can comprise paint, elastomeric materials, metallic materials, composite materials, water-based inks, oil-based inks, plastisol inks, stains, etc. The applique 28 may be applied to the wear-susceptible area 12 using any known method, including the use of adhesives, molding, and heat-transfer methods.

As in the case of the marking, the wear-susceptible indicia 18 also depict a representation of something that has significance to a wearer, an organization, or a cause such that when the indicia 18 progressively wear away, emotional and/or psychological influence occurs. The influence may also be considered adversarial in the sense that that a symbolic intervention occurs when the marking is worn away. The wear-susceptible indicia 18 are made of a material that also wears away at a rate that is the same as or faster than that of the wear-susceptible area 12.

Figure 3:
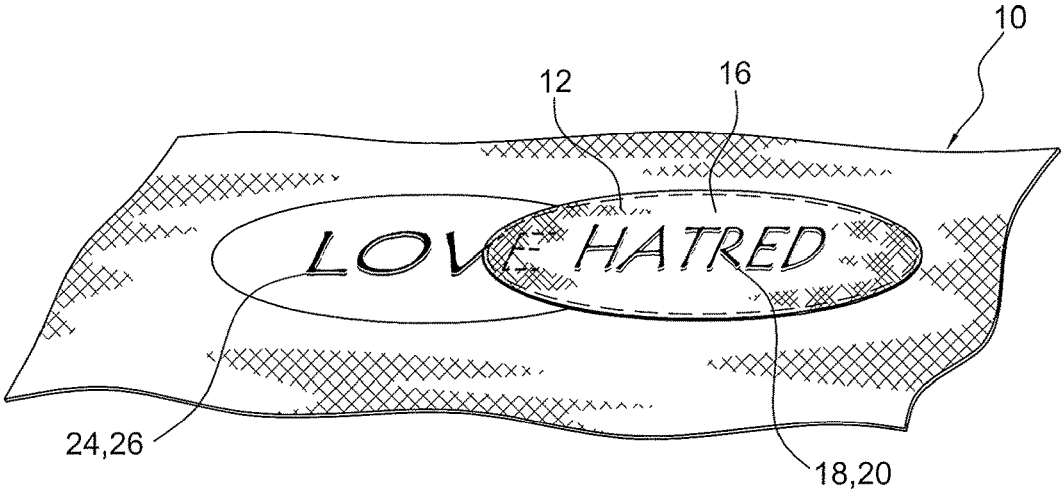
FIG. 3 is a representation of a section of a wearable item having a wear-resistant area that incorporates a marking partially disposed under a wear-susceptible area that incorporates a marking.
Figure 4:
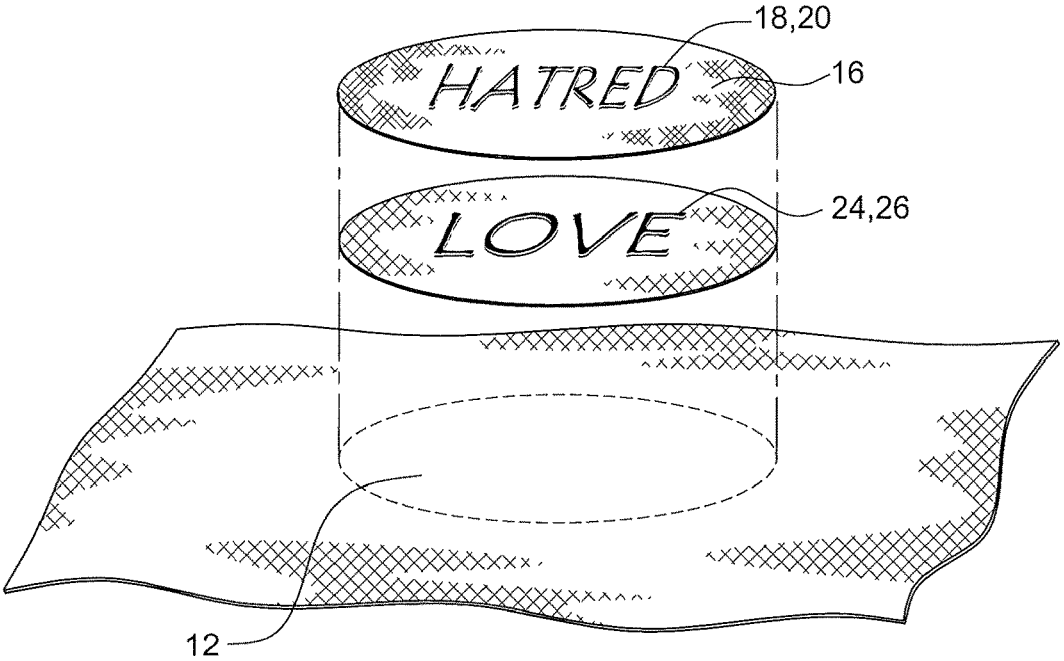
FIG. 4 is a representation of a section of a wearable item having a wear-resistant indicia disposed under wear-susceptible indicia.

In yet another aspect of the invention, shown in FIGS. 3 and 4, the substrate 14 may incorporate a wear-resistant marking 24 or wear-resistant indicia 26 positioned partially or entirely under a wear-susceptible area 12 or wear-susceptible indicia 18. In this aspect, once the wear-susceptible indicia 18 or marking(s) integrated into the wear-susceptible area progressively wear away, the wear-resistant marking 24 or wear-resistant indicia 26 is revealed. This results in a transformative effect that has significance to a wearer, an organization, or a cause such that when the marking or wear-susceptible indicia wears away, emotional and/or psychological influence occurs.

FIG. 5A shows one type of wearable item configured as a sock 100. In this configuration, a marking 20 has been incorporated into a wear-susceptible area 12 on a knitted structure of sock 100. Here, the marking 20 is shown on the upper heel portion 110. As such, the marking is incorporated on a wear-prone area 22. However, the marking may also be incorporated into other areas of the sock that are susceptible to wear. For example, the wear-susceptible area 12 may be incorporated in the ball, toe, or the entirety or partial area(s) of the weight bearing surface.

FIG. 5B shows a sole 200, as positioned on the underside of hosiery, socks, or shoes. For these types of wearable items, multiple wear-susceptible areas 12, markings 20, or indicia 18 are shown. This type of item shows markings or indicia configured as political symbols and disease. When markings and/or indicia are applied in this manner, adversarial influences are symbolically represented as being under the wearer's feet. Thus, a progressive wearing away of the marking and/or indicia can therefore be considered removal from a person's mind over relatively short and/or long periods. In the case of footwear, for example, markings and/or indicia can wear away over the course of a 5K race, a marathon, or any other walking or running event that promotes overcoming a disease or even an emotional or psychological obstacle. At the end of the event, the markings and/or indicia will have progressively worn away to provide positive emotional and psychological influence for those participating in the event.

In this embodiment, wear-susceptible areas 12, markings 20, or indicia 18 may also be removed from the sole when in use and when subject to alternating or substantially constant loads. For example, in the case of socks or hosiery, when in use the sole 200 is subject to both alternating and substantially constant loads due to the weight of the user. Therefore, in this embodiment, emotional and/or psychological influence may occur due to the placement of the wear-susceptible markings and/or indicia "under one's feet." As such, users of the wearable item, may consider themselves as taking a position of authority and/or control of the object represented by the words, picture, and/or symbols placed under their feet.

Figure 6:
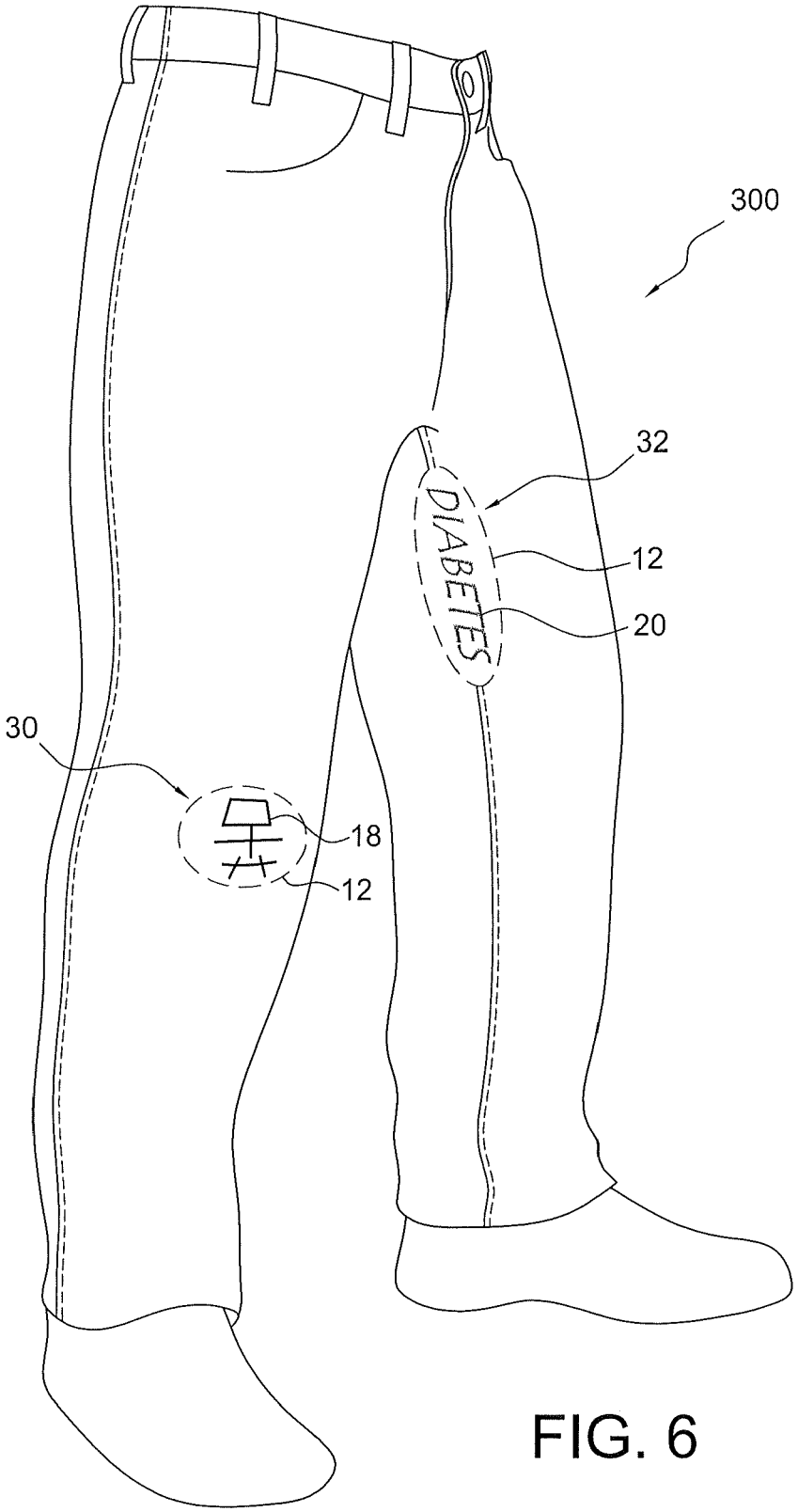
FIG. 6 is a perspective view of a second type of wearable item incorporating both a wear-susceptible area and wear susceptible indicia.

FIG. 6 shows an additional type of wearable item, as pants 300 having wear-susceptible areas 12 with wear-susceptible indicia 18 or markings 20. FIG. 6 shows wear-susceptible areas 12 having indicia 18 or markings 20 positioned on the knee 30 and inner thigh area 32. However, the positioning of the areas, indicia, and/or markings is not to be construed as limiting. Additional areas on the pants may be particularly suitable for placement of indicia and/or markings.

While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A footwear item configured to present a progressive wearing, diminishment, or subsequent absence of a subject, comprising:

a substrate;

a wear-susceptible area incorporated into the substrate and including a pre-stressed area with a weaker material strength than the substrate; and a marking integrated into the wear-susceptible area configured to present the progressive wearing, diminishment, or subsequent absence of the subject that the marking represents;

wherein the pre-stressed area has a two-dimensional area that is generally coextensive with the wear-susceptible area or the marking.

2. The footwear item of claim 1, wherein the wear-susceptible area is disposed on a wear-prone area of the footwear item.

3. A footwear item serving the intent and purpose to present a progressive wearing, diminishment, and subsequent absence of a subject, and presenting a progressive presence of a separate subject, comprising:

a substrate;

a wear-susceptible area;

a wear-susceptible marking integrated into the wear-susceptible area that progressively wears away at a rate faster than the wear-susceptible area; and a wear-resistant marking positioned beneath the wear-susceptible marking, wherein the progressive wearing away of the wear-susceptible marking and the wear resistance of the wear-resistant marking progressively does not present the wear susceptible marking, and progressively presents the wear-resistant marking.

4. The footwear item of claim 3, wherein the wear-susceptible area is disposed on a wear-prone area of the footwear item.

5. The footwear item of claim 3, wherein the wear-susceptible area is positioned at a sole of the footwear item.

6. The footwear item of claim 3, wherein the wear-resistant marking is positioned partially beneath the wear-susceptible marking.

7. The footwear item of claim 3, wherein the wear-resistant marking is positioned completely beneath the wear-susceptible marking.

8. A method of manufacturing footwear items having a substrate and a wear-susceptible area serving the intent and purpose to present a progressive wearing, diminishment, or subsequent absence of a subject, comprising:

incorporating the wear-susceptible area into the substrate;

providing a pre-stressed area within the wear-susceptible area having a weaker material strength than the substrate, wherein the pre-stressed area has a two-dimensional area that is generally coextensive with the wear-susceptible area or a marking; and integrating the marking into the pre-stressed area that progressively wears away over time, wherein the progressive wearing away of the marking serves to present the progressive wearing away, diminishment or absence of a subject.

9. The method of claim 8, wherein the step of incorporating the wear-susceptible area includes positioning the wear-susceptible area at a sole of the footwear item.

10. A footwear serving the intent and purpose to present the wearing, diminishment, or absence of a subject, and presenting the presence of a separate marking subject, comprising:

a substrate;

a wear-susceptible area including a pre-stressed area with a weaker material strength than the substrate;

a wear-susceptible marking, integrated into the wear-susceptible area, that progressively wears away, wherein the pre-stressed area has a two-dimensional area that is generally coextensive with either the wear-susceptible area or the wear-susceptible marking; and a wear-resistant marking positioned beneath the wear-susceptible marking, wherein the progressive wearing away of the wear-susceptible marking and the wear resistance of the wear-resistant marking progressively presents the wear resistant marking.

11. The footwear item of claim 10, wherein the wear-susceptible area is disposed on a wear-prone area of the footwear item.

12. The footwear item of claim 10, wherein the wear-susceptible area is positioned at a sole of the footwear item.

13. The footwear item of claim 10, wherein the wear-resistant marking is positioned partially beneath the wear-susceptible marking.

14. The footwear item of claim 10, wherein the wear-resistant marking is positioned completely beneath the wear-susceptible marking.

15. A footwear item serving the intent and purpose to present a progressive wearing and absence of a subject, comprising:

a substrate;

a wear-susceptible area; and a wear-susceptible marking, integrated into the wear-susceptible area, that progressively wears away at a rate faster than the wear-susceptible area, wherein the marking depicts a phrase or symbol relating to at least one of a disease, a habit, health, politics, and a substance harmful to animals.

16. The footwear item of claim 15, wherein the wear-susceptible area is disposed on a wear-prone area of the footwear item.

17. A method of manufacturing footwear items having a wear-susceptible area configured to present a progressive wearing and subsequent absence of a subject, comprising the steps of:

providing a substrate;

incorporating the wear-susceptible area into the substrate;

providing a pre-stressed area within the wear-susceptible area having a weaker material strength than the substrate; and integrating a marking into the pre-stressed area that is configured to progressively wear away over time, wherein the marking depicts a phrase or symbol relating to at least one of a disease, a habit, health, politics, and a substance harmful to animals, and wherein the pre-stressed area has a two-dimensional area that is generally coextensive with the wear-susceptible area or the marking.

* * * * *